US007124446B2

(12) United States Patent
Demay et al.

(10) Patent No.: US 7,124,446 B2
(45) Date of Patent: Oct. 24, 2006

(54) POTHOLDER

(76) Inventors: Cheryl A. Demay, 415 NW. Nichols Ave., Bremerton, WA (US) 98311; Michael J. Demay, 415 NW. Nichols Ave., Bremerton, WA (US) 98311

( * ) Notice: Subject to any disclaimer, the term of this patent is extended or adjusted under 35 U.S.C. 154(b) by 245 days.

(21) Appl. No.: 10/944,780

(22) Filed: Sep. 21, 2004

(65) Prior Publication Data

US 2005/0114983 A1 Jun. 2, 2005

Related U.S. Application Data

(60) Provisional application No. 60/526,141, filed on Dec. 2, 2003.

(51) Int. Cl.
*A41D 13/08* (2006.01)

(52) U.S. Cl. ..... 2/16; 2/161.6

(58) Field of Classification Search ..... 2/16, 2/20, 158, 161.6; D29/119, 122; 16/435; 294/25; 15/227
See application file for complete search history.

(56) References Cited

U.S. PATENT DOCUMENTS

| | | | | |
|---|---|---|---|---|
| 580,148 | A | | 4/1897 | Staples |
| 2,047,635 | A | | 7/1936 | Johst |
| 2,261,064 | A | | 10/1941 | Katz |
| 2,306,062 | A | | 12/1942 | Katz |
| 2,641,793 | A | | 6/1953 | Wilm |
| 2,651,776 | A | * | 9/1953 | Beatty ..... 2/16 |
| 2,905,946 | A | * | 9/1959 | Goldsmith ..... 2/158 |
| 3,535,708 | A | * | 10/1970 | Beekhuysen et al. ..... 16/435 |
| D233,114 | S | * | 10/1974 | Noyes ..... D29/119 |
| 4,628,544 | A | * | 12/1986 | Erickson ..... 2/158 |
| D336,549 | S | | 6/1993 | Stabile |
| 6,112,372 | A | | 9/2000 | Zhou et al. |
| 6,298,488 | B1 | | 10/2001 | Duncan et al. |
| D476,778 | S | | 7/2003 | Beyda |
| 6,684,460 | B1 | * | 2/2004 | Cuff ..... 16/435 |
| 2003/0140395 | A1 | | 7/2003 | Newcomb |

* cited by examiner

*Primary Examiner*—Katherine Moran
(74) *Attorney, Agent, or Firm*—Richard C. Litman

(57) ABSTRACT

The potholder is a hand protection device with a generally rectangular body having two outer surfaces, at least one layer of flexible insulating material disposed within the body, and two pockets disposed on one of the outer surfaces. The layers of the potholder provide sufficient thickness to reduce the amount of heat radiating through the potholder from the heated object to the hand. Each pocket covers about half the entire area of the potholder and is positioned so that the openings of the pockets face each other. The fingers of a hand are placed in one pocket and the thumb is inserted in the opposite pocket. The pockets retain the potholder on the hand and prevent accidental burns incurred by grazing a hot object. A number of horizontal rows of stitches are sewn between the pockets to form a crease that facilitates the folding of the potholder.

17 Claims, 5 Drawing Sheets

POTHOLDER

CROSS-REFERENCE TO RELATED APPLICATION

This application claims the benefit of U.S. Provisional Patent Application Ser. No. 60/526,141, filed Dec. 2, 2003.

BACKGROUND OF THE INVENTION

1. Field of the Invention

The present invention relates to potholders, and more particularly to a potholder having pockets to insert the fingers and the thumb of a hand.

2. Description of the Related Art

No kitchen is without something to protect one's hand when cooking, whether it is an oven mitt, a potholder pad or a towel. A common problem with current potholders is that they are too thin and must be folded so heat does not radiate through to the hand. Hand protectors such as oven mitts are too loose and move around on the hand, while traditional potholder pads do not cover the back of one's hand and do not provide a place to gripping the pad. Because protecting one's hands from heat is important, a number of hand protectors have been developed to meet this need.

U.S. Pat. No. 580,148, issued to Staples on Apr. 6, 1897, describes a permanently curved potholder having an oblong shape. The potholder comprises a number of layers of non-heat-conducting material, such as paper. The curvature of the potholder is maintained by a number of longitudinal rows of stitches. The layers of non-heat-conducting material are sandwiched between outer layers of cotton or felt. U.S. Pat. No. 2,047,635, issued to Johst on Jul. 14, 1936, describes a "U" shaped hand protector pad. The protector is preferably made of a single sheet of vulcanized rubber. The rubber is resilient, permitting the protector to easily bend over and enfold an object yet still maintain its "U" shape.

Some hand protectors have been developed with a pocket or a band to keep the fingers, but not the thumb, of a hand on the hand protector. U.S. Pat. No. 2,306,062, issued to Katz on Dec. 22, 1942, describes a hot pad. The hot pad is made from oilcloth in either a round or a square shape, and possesses a very thin amount of internal filler. The hot pad utilizes either an open-ended sleeve or a band disposed on the back of the pad that permits the fingertips of a user's hand to hang over the pad's edge, and the thumb to grasp the back portion of the hot pad.

U.S. Pat. No. 2,261,064, issued to Katz on Oct. 28, 1941, describes a hot pad having a hand-receiving pocket. The pocket covers a considerable portion of the hot pad, but still provides space for the thumb to sit outside the pocket and grip the pad. U.S. Des. Pat. No. 476,778, issued to Beyda on Jul. 1, 2003, shows an ornamental design for a potholder. The potholder is made of terry cloth and has a pocket for inserting a hand.

Other hand protectors have been developed as potholders either without a pocket or with a pocket to insert only the handle of cookware. U.S. Pat. No. 2,641,793, issued to Wilm on Jun. 16, 1953, describes a magnetic potholder. The potholder has two panels and filler material quilted between the two panels. The panels are made of plastic material or oilcloth and the filler is cotton batting or any other type of insulating material. The potholder attaches to a magnetic surface by a magnet that is disposed at one corner of the potholder.

U.S. Des. Pat. No. 336,549, issued to Stabile on Jun. 15, 1993, shows an ornamental design for a hot pad. The hot pad is relatively thin and lacks pockets. U.S. Pat. No. 6,112,372, issued to Zhou et al. on Sep. 5, 2000, describes a heat-resistant potholder comprising more than one panel. The panels of the potholder form a pocket or pouch to insert the handle of kitchenware. Cotton batting is disposed between the panels of the potholder to provide extra protection from hot handles inserted in the pocket.

Still other hand protectors have been developed in the form of a glove or mitt. U.S. Pat. No. 2003/0140395, published on Jul. 31, 2003, describes an oven glove having heat retardant elements on the thumb, the fingers and the palm of the hand. A gripping element is attached to and extends from the thumb, allowing the user to grasp and manipulate an item by placing the thumb over the edge of a pan.

U.S. Pat. No. 2,905,946, issued to Goldsmith on Sep. 29, 1959, describes hand protectors having an inner layer sandwiched between two outer layers. The outer layer is made of cloth that is coated with silicone and plastic material containing aluminum powder, making the hand protector waterproof and heat reflective, respectively. The inner layer is made of natural or synthetic foam polymer, as well as natural or synthetic rubber.

U.S. Pat. No. 6,298,488, issued to Duncan et al. on Oct. 9, 2001, describes a kitchen grip taking on several forms, such as a hand mitt or a lid holder. In most embodiments, the grip comprises two sheets, one surface being made of nylon/polyester fabric and being water and stain resistant, the second surface being a temperature-controlling, non-slip chloride rubber that is affixed to the nylon/polyester fabric.

None of the above inventions and patents, taken either singly or in combination, is seen to describe the instant invention as claimed. Thus a potholder solving the aforementioned problems is desired.

SUMMARY OF THE INVENTION

The potholder of the present invention is a hand protection device comprising a generally flat rectangular body having two outer surfaces sandwich insulating material. The insulating material provides sufficient thickness to reduce the amount of heat radiating through the potholder from the heated object to the hand. Stitches are made to the potholder to keep the insulating material in place and prevent it from shifting within the potholder. Two pockets are disposed on one surface of the body. Each pocket covers about half the entire area of the potholder and is positioned so that the openings of the pockets face each other. The fingers of a hand are placed in one pocket and the thumb is inserted in the opposite pocket. The pockets help to keep the potholder on the hand and protect the thumb, fingers and portions of the back of the hand from accidental burns incurred by grazing a hot object. A number of horizontal rows of stitches are sewn between the pockets to create a crease. The crease helps a user to easily manipulate the potholder and facilitate the folding of the potholder.

Accordingly, it is a principal object of the invention to provide a potholder that has a pocket for the fingers and a pocket for the thumb, thereby allowing the user to keep the potholder on one's hand.

It is another object of the invention to provide a potholder that covers the one's thumb and fingers to protect the hand from heat and accidental contact with a hot object, or with an oven as one pulls their hand out of the oven.

It is a further object of the invention to provide a potholder having sufficient thickness to significantly reduce the amount of heat radiating to one's hand when holding or touching hot cookware.

Still another object of the invention is to provide a potholder having sufficient flexibility that the potholder can be easily manipulated despite its thickness.

It is an object of the invention to provide elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
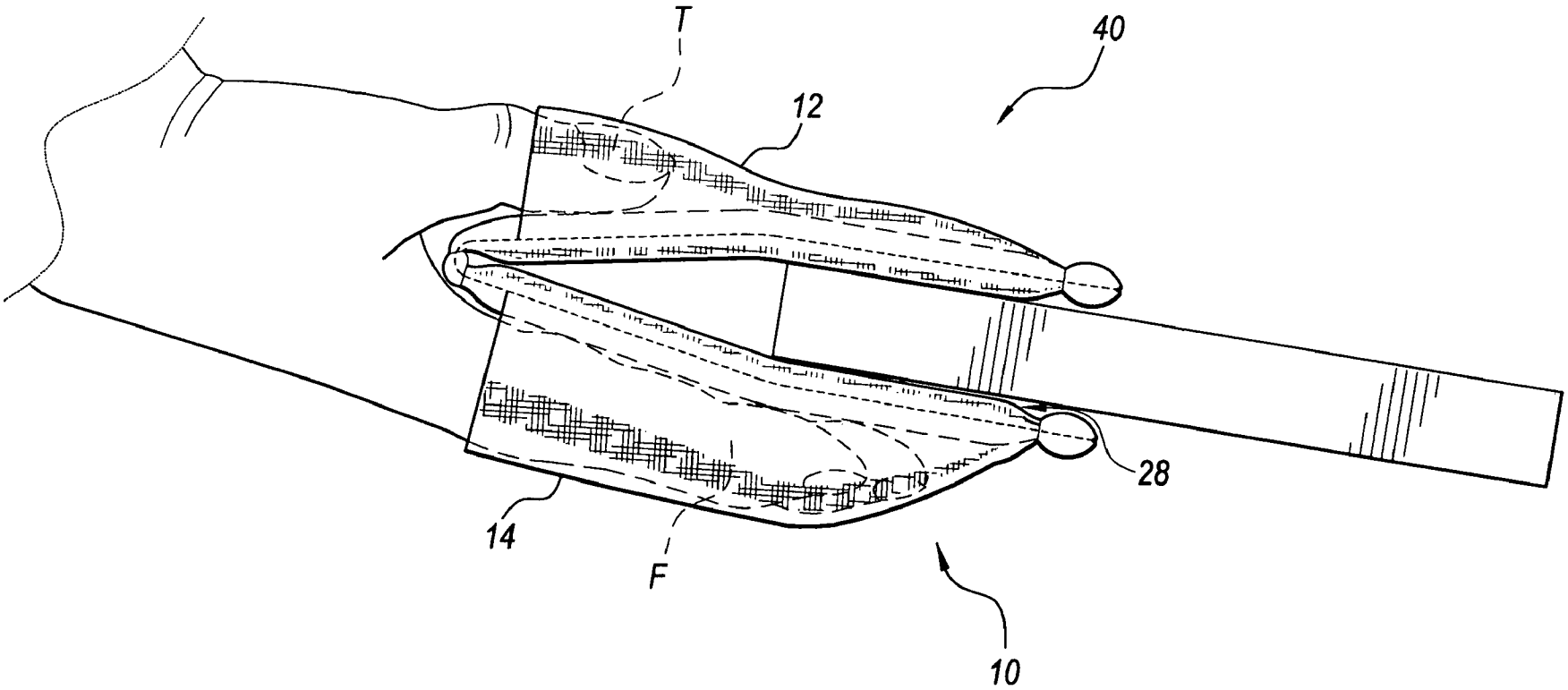
FIG. 1 is an environmental, perspective view of a potholder according to the present invention.
Figure 2:
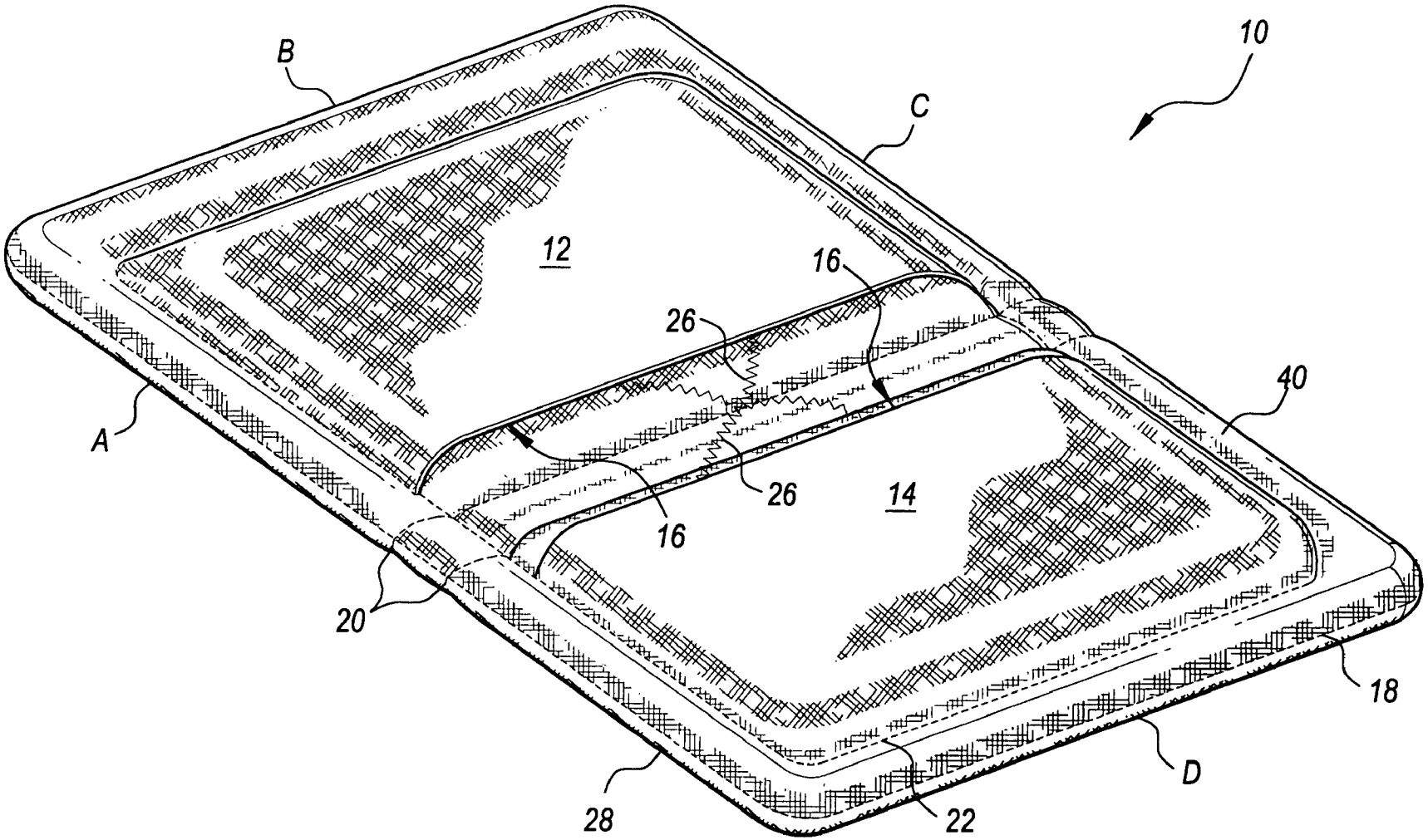
FIG. 2 is a perspective view of a potholder according to the present invention showing the pockets.

The present invention is a potholder, designated generally as 10 in the drawings. As shown in FIG. 1, the potholder 10 permits a user to insert fingers F and a thumb T in pockets disposed on the potholder 10 in order to retain the potholder 10 on the user's hand while folding the potholder in half to grasp a hot piece of cookware. The potholder 10 has a generally flat rectangular shape with insulating material sandwiched between a front outer surface 28 and a rear outer surface 40. The potholder 10 has two pockets 12, 14 disposed adjacent each other on rear surface 40. The front surface 28 is intended to contact hot items, such as a hot pan. Although potholder 10 is preferably made with pockets 12, 14 on one side, it is conceivable that both sides of the potholder 10 could have pockets so the user can insert their fingers F and thumb T from either side of the potholder 10.

Referring to FIGS. 2–5, a seam 18 joins front surface 28 to rear surface 40 and encloses the insulating material 30, 32, 34, 36, and 38 within the potholder 10. The seam 18 is sewn around the periphery of the surfaces 28, 40 along edges A, B, C, D.

Figure 3:
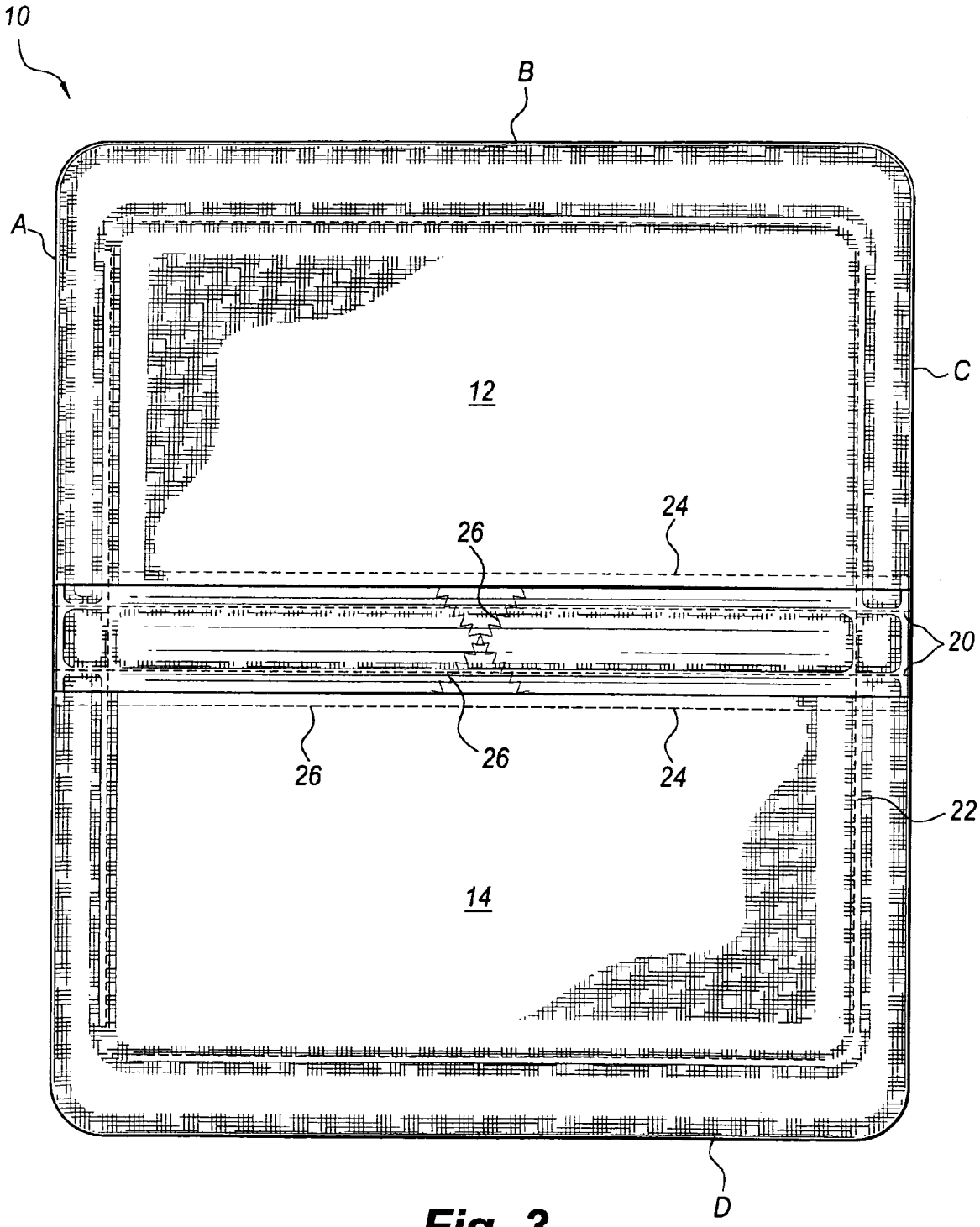
FIG. 3 is a rear view of a potholder according to the present invention.

FIG. 3 shows another seam 22 sewn through the surfaces 28, 40 adjacent the periphery of the potholder 10. The seam 22 is preferably between ¾" and 1" from each edge A, B, C, D. Seam 22 makes pockets 12, 14 smaller, helping to keep the tips of the finger F away from the edges A, B, C, D of the potholder 10 and accidentally touching something hot. Seam 22 also keeps the insulating material 30, 32, 34, 36, 38 from shifting or bunching within the potholder 10.

The pockets 12, 14 are preferably each four-sided. Three of the four sides are sewn to the rear surface 40 at the edges A, B, C, D and one side is left open to form the pocket opening 16. Pocket 12 is sewn to edges A, B, C, and pocket 14 is sewn to edges A, D, C. A hem 24 is sewn into each open side 16 of the pockets 12, 14 to give the pockets 12, 14 a finished look and to keep the open side from fraying. The hem 24 is optional.

The pocket opening 16 of each pocket 12 and 14 faces the middle of the potholder 10, as well as the pocket opening 16 of the opposite pocket. The position of the pockets 12, 14, being adjacent each other, allows the fingers F to be inserted into one pocket and the thumb T to be inserted into the opposite pocket. The thumb T and fingers F are inserted into the pockets 12, 14 through the pocket opening 16 of each pocket 12, 14.

Unlike traditional potholder pads that lack pockets, the pockets 12, 14 on the potholder 10 help keep the potholder 10 on the user's hand without exerting much effort. Additionally, the pockets 12 and 14 provide some protection to the back of the hand, the fingers F and the thumb T from burns that may be incurred when accidentally grazing something hot. Accidental burns are common when using a traditional potholder pad that lacks pockets, especially when reaching into and out of a hot oven. The pockets 12, 14 on potholder 10 together cover almost the entire rear surface 40, with each pocket covering about half the rear surface 40.

Figure 4:
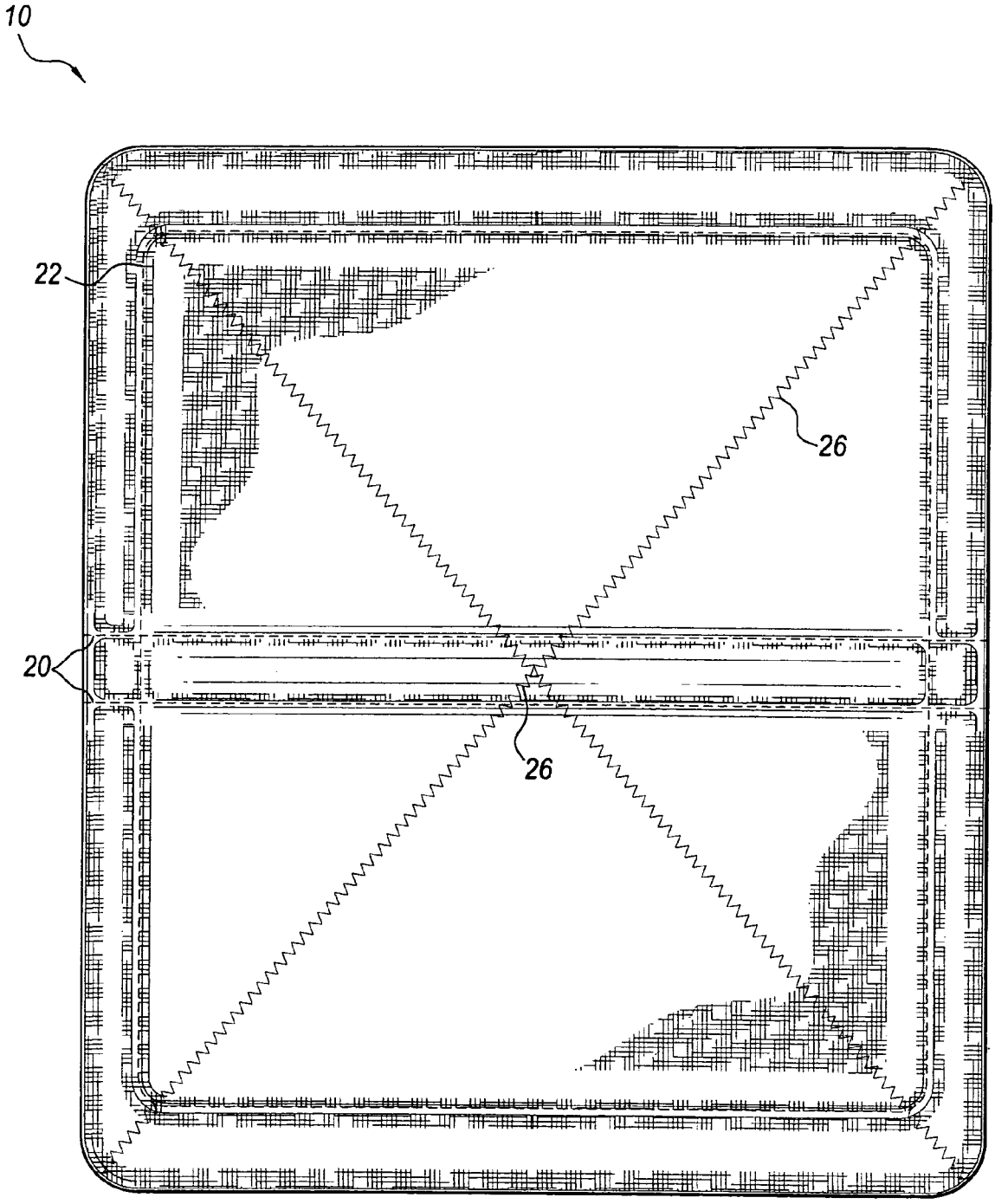
FIG. 4 is a front view of a potholder according to the present invention.

As seen most clearly in FIG. 4, a pattern of stitches forms an "X" between the corners of the potholder 10, which is sewn across the front surface under pockets 12, 14. The "X" pattern of stitches 26 fixes the layers of insulating material 30, 32, 34, 36, 38, preventing the insulating layers from sliding across each other and bunching up between the two outer layers 28 and 40. As shown in FIG. 3, parallel rows of stitches 20 are sewn transversely across the rear surface of the potholder 10, defining ¾" wide horizontal space between each pocket 12, 14. The seams 20 provide creases to help the user easily fold the potholder 10 despite the thickness of the insulating material 30, 32, 34, 36, 38 disposed within the body. Normally, the potholder 10 is generally flat and therefore must be manipulated by the user to hold any sized object. The crease helps the user to easily fold the potholder 10. Although potholder 10 is described with two horizontal stitches 20, one horizontal seam or more than two horizontal seams 20 can be sewn in between pockets 12, 14 and still allow the potholder 10 to fold the potholder 10.

Figure 5:
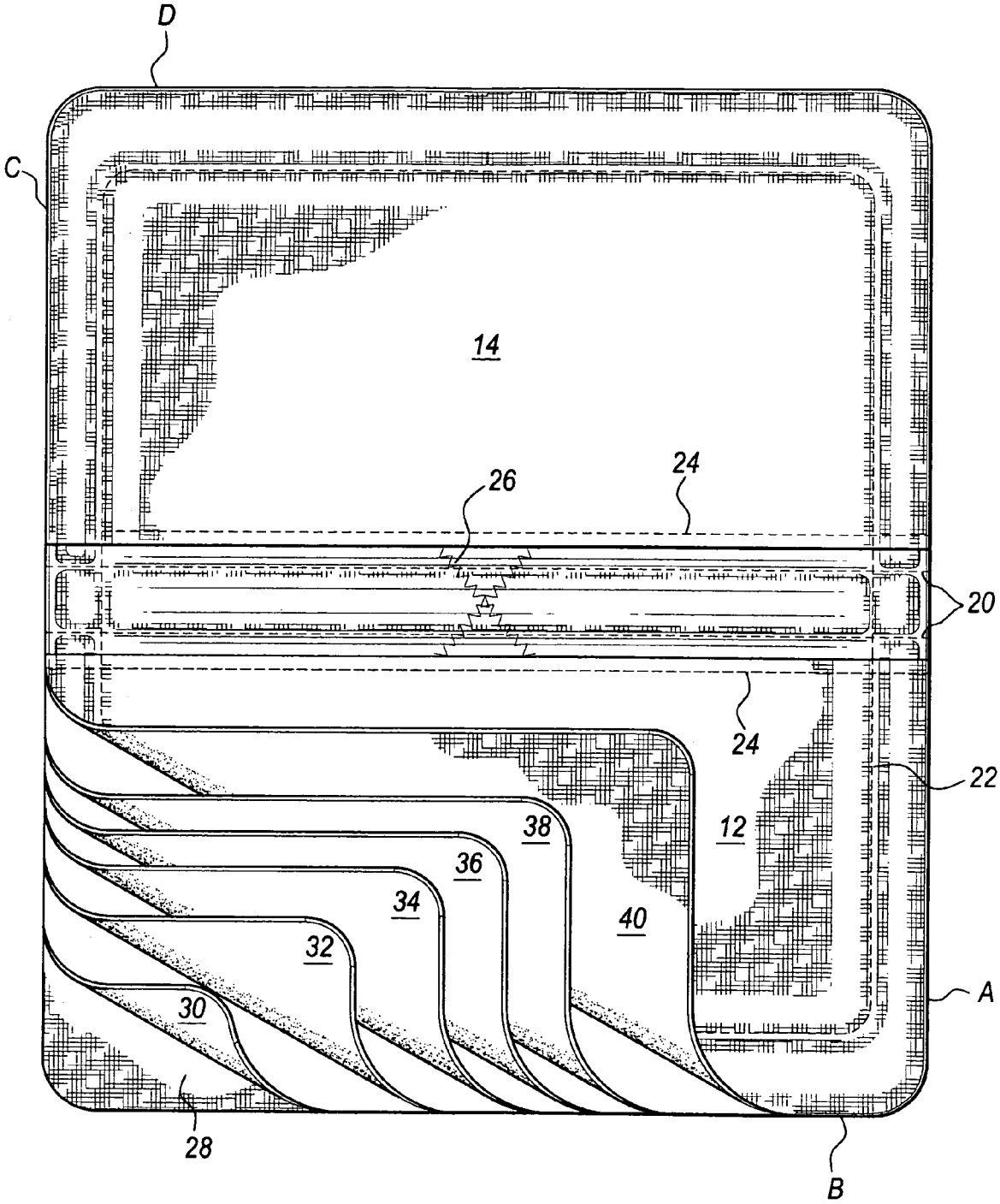
FIG. 5 is a rear view of a potholder according to the present invention with a corner broken away and the inner layers folded back to show the insulation material.

As shown in FIG. 5, the entire space between rear surface 40 and front surface 28 of potholder 10 is filled with insulation material 30, 32, 34, 36, 38. Preferably, the insulation material has five layers; each layer is about 8" by 10" with the final manufactured potholder 10 also being about 8" by 10". Starting from the front surface 28 the potholder 10 is arranged in the following order: the front surface 28; single sided fusible polyester batting 30; double sided fusible cotton batting 32; a first layer of terry cloth 34; a second layer of terry cloth 36; double sided fusible cotton batting 38; the rear surface 40; and finally the pockets 12, 14 disposed on the rear surface 40.

Front surface 28, rear surface 40 and the pockets 12, 14 are constructed from cotton material but could also be made from other materials. Similarly, the insulation material can be made from the same materials or different materials from those described above, having the same or a different order from that described above. Furthermore, the inner insulation material may be one thick layer of material or a number of layers thick, so long as it can reduce the amount of heat radiating through the potholder 10, and provided that the inner insulation material is made from a flexible material to permit easy folding about the creases 20. Thus, the number of layers of the insulating material may be more or less than five layers.

The potholder 10 is constructed by attaching together a group of layers of insulting material 30, 32, 34, 36, 38 to each surface 28 and 40 and then sewing the two pieces together, inside out, with seam 18. The seam 18 is sewn along the edges of the insulation material 30, 32, 34, 36, 38. Since, the exterior portions of the outer surfaces 28, 40 are sewn facing each other, a small portion of one of the edges is left un-sewn so the potholder 10 can be reversed, right side out and then sewn shut by hand, completing the seam 18.

The layers attached to the interior side of the front surface 28 are the single sided fusible polyester batting 30, the layer of double sided cotton/polyester batting 32 and the terry cloth layer 34. The fusible side of the polyester batting 30 is placed on the interior side of the front surface 28 and ironed in place. Then, the layer of double-sided cotton/polyester batting 32 is laid on top of the polyester batting 30 but under one terry cloth layer 34. A hot iron is placed on top of the terry cloth layer 34 to fuse the terry cloth layer 34 onto one side of the cotton/polyester batting 32 and the polyester batting 30 to the other side of the cotton/polyester batting 32.

A layer of double sided fusible cotton batting 38 and one layer of terry cloth 36 is laid out upon and centered on the rear surface 40 and ironed together. After the insulating material 30, 32, 34, 36, 38 is joined to the respective outer surfaces 28, 40, stitches 26 are sewn into each surface 28, 40. One set of stitches 26 is sewn into the polyester batting 30, the cotton/polyester batting 32, the terry cloth layer 34 and front surface 28 to join the layers as one quilted piece.

A second set of stitches 26 is sewn into the terry cloth layer 36, the cotton batting 38 and the rear surface 40 to form a second quilted piece. The stitches 26 are sewn into each quilted piece in the form of an "X". The stitches 26 keep the layers from moving and bunching. After the terry cloth 36, the cotton batting 38 and rear surface 40 are quilted together, pockets 12, 14 are sewn on the exterior face of rear surface layer 40. Once the pockets 12, 14 are in place, the rear surface 40 and front surface 28 are placed together, right side in, and seam 18 is sewn into surface. 28, 40 around the insulating material 30, 32, 34, 36, 38. By pulling the potholder 10, right side out, the two terry cloth layers 34 and 36 that were the outer layers of the first quilted piece and the second quilted piece, respectively, are now juxtaposed next to each other in the right side out potholder 10.

It is to be understood that the present invention is not limited to the embodiment described above, but encompasses any and all embodiments within the scope of the following claims.

We claim:

1. A potholder, comprising:

a first flexible fabric outer surface and a second flexible fabric outer surface, the first and second surfaces having a periphery and being joined together about the periphery, the first and second surfaces forming a generally flat potholder body;

at least one layer of flexible insulation material disposed between the first and second outer surfaces;

at least two pockets disposed on the first outer surface, each of the pockets having an opening, the two pocket openings facing each other; and at least one seam sewn through the potholder body between the two pockets parallel to the pocket openings and defining a crease about which the body is folded;

whereby the first pocket retains a user's thumb and the second pocket retains fingers of the hand allowing the user to retain the potholder on the hand while folding the potholder along the crease in order to grasp hot cookware.

2. The potholder according to claim 1, wherein there are two pockets.

3. The potholder according to claim 1, wherein there are at least two pockets.

4. The potholder according to claim 1, wherein the pockets cover half the entire area of the potholder.

5. The potholder according to claim 1, wherein the pockets are each four-sided where three sides are sewn to the periphery of the body and the fourth side is open and faces the fourth open side of the second pocket to insert the fingers and thumb of a hand, respectively.

6. The potholder according to claim 1, further comprising a seam sewn through the potholder body being a distance from the periphery of the potholder, the seam making the pockets smaller allowing the user to keep the tips of the finger away from the periphery of the potholder and accidentally touching something hot.

7. The potholder according to claim 1, further comprising a second seam sewn in between and parallel to the pocket openings further defining the crease about which the body folds.

8. The potholder according to claim 1, wherein the insulation material is generally flat and is dimensioned and configured to fit within the periphery of the first and second surfaces.

9. The potholder according to claim 1, wherein said insulation material is one layer.

10. The potholder according to claim 1, wherein said insulation material is two layers.

11. The potholder according to claim 1, wherein said insulation material is at least two layers.

12. The pot holder according to claim 1, wherein the insulation material comprise at least one layer of a single sided fusible polyester batting, at least one layer of a double sided fusible cotton batting, at least one layer of a terry cloth material and at least one layer of a double sided fusible cotton batting.

13. The potholder according to claim 1, wherein the outer surfaces are made of cotton.

14. The potholder according to claim 1, further comprising a number of stitches sewn across the body preventing the insulation material from shifting.

15. The pot holder according to claim 1, further comprising at least two pockets disposed on the second outer surface, each of the pockets having an opening, the two pocket openings facing each other allowing the user to use the potholder from either side of the potholder.

16. A potholder, comprising:

a first flexible fabric outer surface and a second flexible fabric outer surface, the first and second surfaces having a periphery and being joined together about the periphery, the first and second surfaces forming a generally flat potholder body;

insulation material disposed between the first and second outer surfaces, the insulation material comprising at least one layer of a single sided fusible polyester batting, at least one layer of a double sided fusible cotton batting, at least one layer of a terry cloth material and at least one layer of a double sided fusible cotton batting;

two pockets disposed on the first outer surface, each of the pockets having an opening, the openings of the two pockets facing each other, each pocket being disposed over half the entire area of the potholder;

at least one seam sewn through the potholder body between the two pockets parallel to the pocket openings and defining a crease;

a seam sewn through the potholder body being a distance from the periphery of the potholder, the seam making the pockets smaller allowing the user to keep the tips of the finger away from the periphery of the potholder and accidentally touching something hot; and whereby the first pocket retains a user's thumb and the second pocket retains fingers of the hand allowing the user to retain the potholder on the hand while folding the potholder along the crease in order to grasp hot cookware.

17. A potholder, comprising:

a first flexible fabric outer surface and a second flexible fabric outer surface, the first and second surfaces having a periphery and being joined together about the periphery, the first and second surfaces forming a generally flat potholder body;

insulation material disposed between the first and second outer surfaces;

two pockets disposed on the first outer surface, each of the pockets having an opening, the openings of the two pockets facing each other, each pocket being disposed over half the entire area of the potholder;

at least one seam sewn through the potholder body between the two pockets parallel to the pocket openings and defining a crease;

a seam sewn through the potholder body being a distance from the periphery of the potholder, the seam making the pockets smaller allowing the user to keep the tips of the finger away from the periphery of the potholder and accidentally touching something hot; and whereby the first pocket retains a user's thumb and the second pocket retains fingers of the hand allowing the user to retain the potholder on the hand while folding the potholder along the crease in order to grasp hot cookware.

* * * * *